United States Patent [19]

Kuragaki

[11] Patent Number: 4,934,969

[45] Date of Patent: Jun. 19, 1990

[54] TILT MECHANISMS FOR INBOARD/OUTBOARD ENGINES

[75] Inventor: Naoyoshi Kuragaki, Hamamatsu, Japan

[73] Assignee: Sanshin Industries Kogyo Kabushiki, Hamamatsu, Japan

[21] Appl. No.: 285,779

[22] Filed: Dec. 16, 1988

[30] Foreign Application Priority Data

Dec. 18, 1987 [JP] Japan ..... 62-320607
Dec. 18, 1987 [JP] Japan ..... 62-320608

[51] Int. Cl.[5] ..... B63H 21/26

[52] U.S. Cl. ..... 440/1; 440/53; 440/57; 440/58; 440/62; 440/63

[58] Field of Search ..... 440/49, 53–55, 440/57–60, 62–65, 1

[56] References Cited

U.S. PATENT DOCUMENTS

| | | | |
|---|---|---|---|
| 3,468,282 | 9/1969 | Wintercorn | 440/1 |
| 3,894,250 | 7/1975 | Hager | 440/53 |
| 4,605,375 | 8/1986 | Ferguson | 440/1 |
| 4,734,065 | 3/1988 | Nakahama | 440/1 |
| 4,757,971 | 7/1988 | Mapes | 440/1 |
| 4,759,731 | 7/1988 | Uchida | 440/1 |

FOREIGN PATENT DOCUMENTS

| | | | |
|---|---|---|---|
| 60-234094 | 11/1985 | Japan | 440/1 |

*Primary Examiner*—Joseph F. Peters, Jr.
*Assistant Examiner*—Clifford T. Bartz
*Attorney, Agent, or Firm*—Ernest A. Beutler

[57] ABSTRACT

A rotary switch and mounting arrangement therefore adapted to be detachably mounted on the gimbal housing of an outboard drive unit for controlling its power tilt and trim mechanism.

10 Claims, 3 Drawing Sheets

TILT MECHANISMS FOR INBOARD/OUTBOARD ENGINES

BACKGROUND OF THE INVENTION

This invention relates to a tilt mechanism for an inboard outboard engine and more particularly to an improved control for the tilt mechanism.

It is well known to employ an outboard drive unit that is mounted on the transom of an associated water craft and which is supported for tilt and trim movement relative to the transom. These outboard drives normally, particularly in larger sizes, employ a power device that is operative to effect the tilt and trim movement. Normally the power device is operated from a remotely positioned operator control switch so that the operator may adjust the tilt and trim at a position remotely from the outboard drive. Although this has a number of advantages, there are times when it is desirable for the operator to effect the tilt and trim movement either directly at the outboard drive. This is particularly useful when the water craft may be out of the water and the operator wishes to achieve the trim movement for either servicing or other purposes. With the remotely positioned switches, the operator must enter the water craft and operate the remotely positioned switch, which is obviously inconvenient.

It is, therefor, a principal object to this invention to provide an improved control unit for a marine outboard drive.

It is a further object of this invention to provide a tilt and trim control unit for a marine outboard drive wherein an operating switch is disposed on the outboard portion of the drive.

If a switch is mounted externally of the water craft directly on the outboard drive, there are certain problems that result. For example, the switch must be operated in such a way that it cannot be accidentally engaged or operated. Although toggle type switches may be utilized in conjunction with the inboard control, these switches may not be satisfactory for an outboard mounting because of the likelihood of inadvertent actuation. Further more, the switch should be of the type that is water proof and cannot be easily damaged by water in view of its mounting location.

It is, therefore, a still further object of this invention to provide an improved switch mechanism for operating the tilt and trim of an outboard drive.

It is a further object of this invention to provide an improved switch and mounting mechanism for a marine outboard drive in which the switch can be quickly and conveniently mounted and demounted for servicing and or replacement.

SUMMARY OF THE INVENTION

A first feature of this invention is adapted to be embodied in a marine outboard drive that is adapted to be mounted on the transom of a water craft hull containing a prime mover. The outboard drive is comprised of an outer housing and a support unit. A propulsion unit adapted to be driven by the prime mover is contained within the outer housing. The outer housing and supporting unit are mountable on the transom for tilt and trim movement of the outer housing relative to the supporting unit. Power means are interposed between the transom and the outboard drive for achieving power tilt and trim adjustment. In accordance with this feature of the invention, switch means are carried by the outboard drive for operating the power means.

Another feature of this invention is adapted to be embodied in a switch construction for controlling the power means of an outboard drive tilt and trim unit of the type described in the preceding paragraph. In accordance with this feature of the invention, the switch means comprises a housing that has a readily detachable connection to the outboard drive and which contains a rotary switch. An external rotary switch actuator is mounted on the housing and is accessible by an operator for operating the power means.

DETAILED DESCRIPTION OF THE PREFERRED EMBODIMENT OF THE INVENTION

Figure 1:
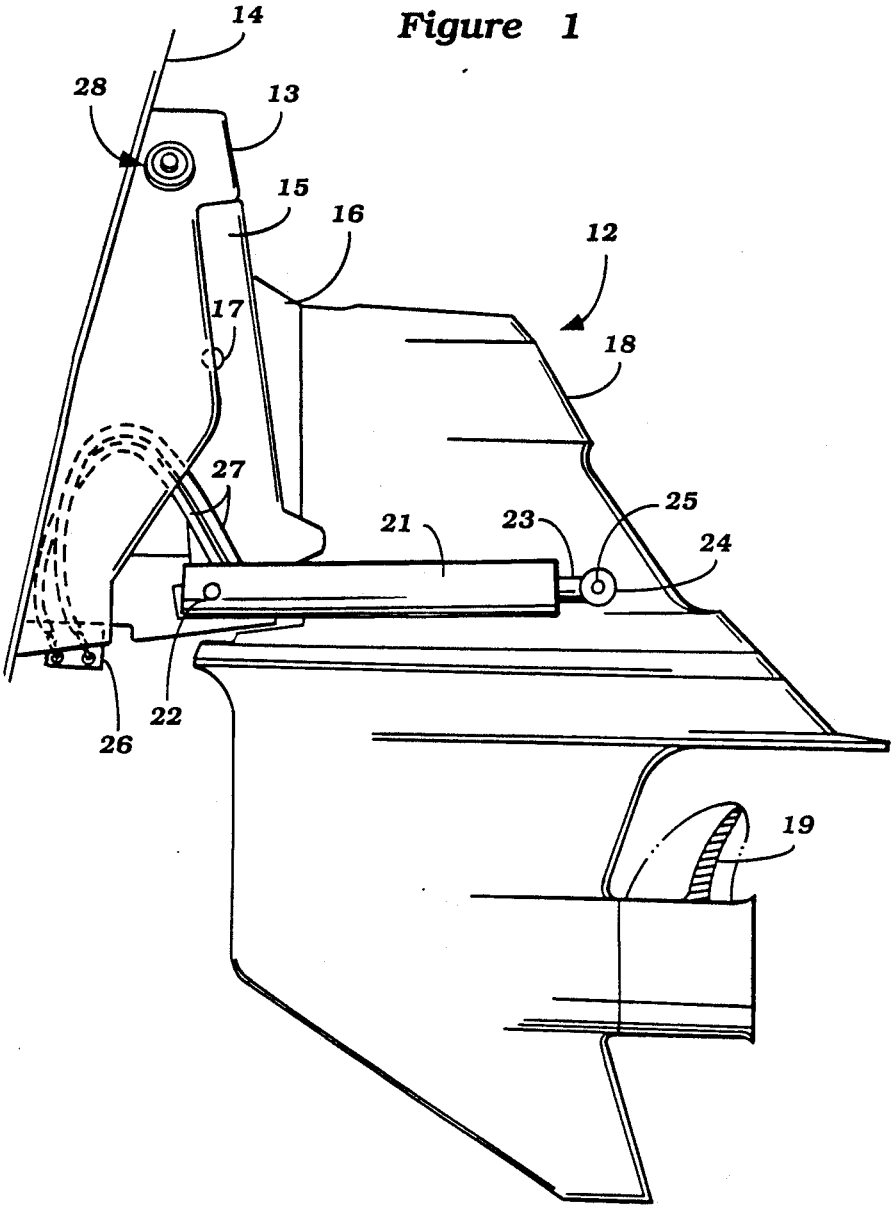
FIG. 1 is a side elevational view of a marine outboard drive constructed in accordance with an embodiment of the invention, as attached to the transom of an associated water craft.

Referring first to FIG. 1, a marine outboard drive constructed in accordance with an embodiment of the invention is identified generally by the reference numeral 12. The outboard drive is comprised of a number of components including a transom plate or gimbal housing 13 that is adapted to be affixed in a known manner to a transom 14 of an associated water craft that is shown only partially. The water craft 14 has a hull that contains a prime mover such as a internal combustion engine. In addition, the operation of the water craft is controlled by steering and throttle mechanisms that are remotely positioned in the hull and accessible to the operator.

A gimbal ring 15 is affixed to the gimbal housing 13 and is supported for steering movement about a generally vertically extending axis. A first housing portion 16 of the outboard drive unit 12 is pivotally connected to the gimbal ring 15 by means of a pair of pivot pins 17 for pivotal movement of the outboard drive unit 12 about a generally horizontally extending axis between a plurality of trim ad tilt adjusted positions.

The housing 16 is connected to a further housing 18 in which a transmission mechanism is provided for driving a propeller 19 in selected forward and reverse directions. The propeller 19 and transmission unit, which may be of any known type, are powered by the engine positioned within the hull of the water craft in a known manner.

The tilt and trim movement of the outboard drive 12 and specifically its housing 16 and 18 relative to the gimbal ring 15 is controlled by a means of hydraulically operated cylinder assemblies 21. The cylinder assemblies 21 are connected to the gimbal ring 15 at one end by means of pivot pins 22. A piston rod 23 of each cylinder assembly 21 has a trunion portion 24 that is connected by means of a pivot pin 25 to the housing 18. As a result, extension of the piston rods 23 will effect pivotal movement of the housing assembly 16 and 18 about the pivot pins 17.

A distributor value block 26 is mounted on the underside of the gimbal housing 13 and is connected by a pair of flexible conduits 27 to the fluid motors 21 for operating them. Pressurized fluid is supplied to the valve block 26 from a hydraulic system that is operated by an electric motor contained within the hull of the water craft forwardly of the transom 14 in a known manner. A remotely positioned switch may be positioned by the operators area so as to permit remote control of the fluid motors 21 and tilt and trim adjustment.

Figure 2:
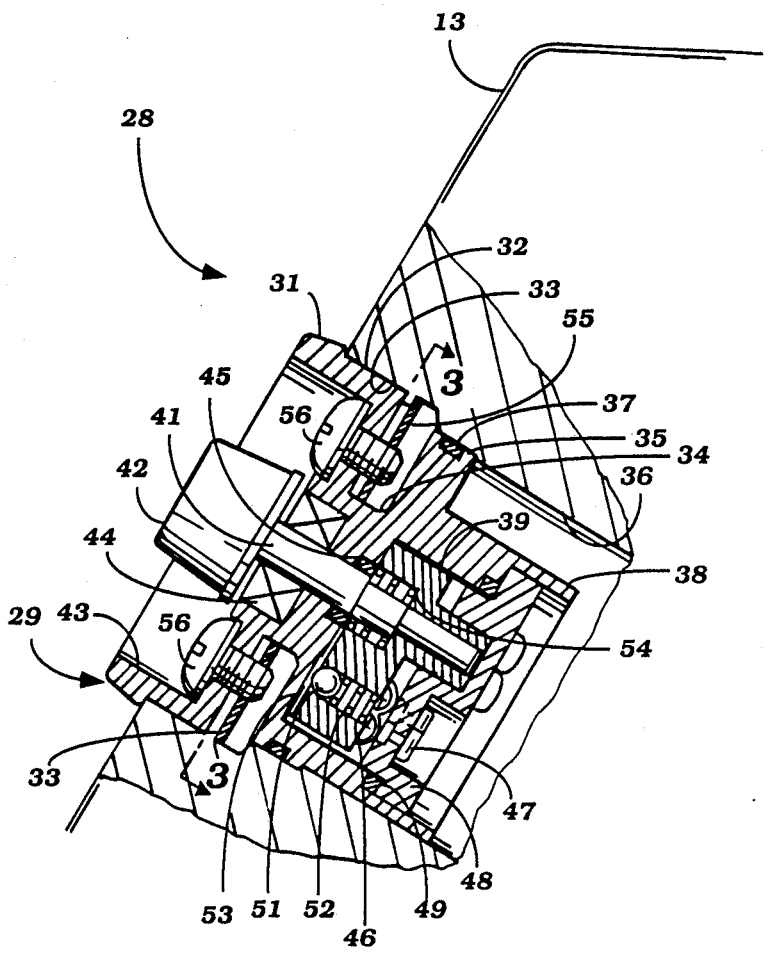
FIG. 2 is an enlarged cross-sectional view of the switch for controlling the tilt and trim operation of the outboard drive.
Figure 4:
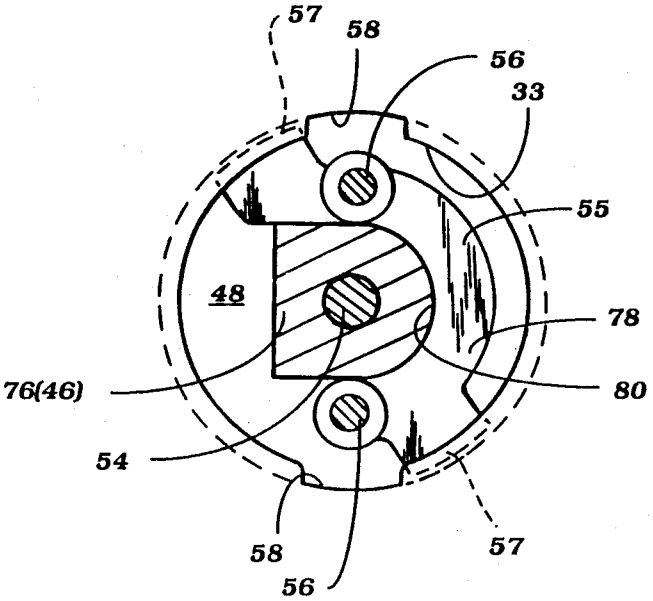
FIG. 4 is a cross-sectional view, in part similar to FIG. 3, showing the switch in its fully installed position.

There are times, of course, when the operator would like to be able to adjust the trim position of the outboard drive 12 from externally of the water craft. To this end, there is provided a control switch indicated generally by the reference numeral 28 and constructed in accordance with an embodiment of the invention for operating the hydraulic system and making the trim and tilt adjustments. The switch assembly 28 and its mounting on the gimbal housing 13 of the outboard drive unit 12 may be best understood be reference to FIGS. 2 through 4. It should be noted that the switch assembly 28 includes an outer housing, indicated generally by the reference numeral 29 that has a first cylindrical part 31 that has a reduced diameter section 32 that is received within a first bore 33 of the gimbal housing 13.

A recessed area 34 of the outer housing 39 interconnects the portion 31 with a portion 35 that is received within a bore 36 that is coaxially disposed with the bore 33 but slightly smaller in diameter. An "O" ring seal 37 is received within a groove i the portion 35 so as to effect a water tight seal.

The housing portion 35 has depending from it a smaller diameter housing portion 38 in which the switch mechanism per se is located. This switch mechanism per se includes an internal cavity in which rotatably mounted switch element 39 is positioned. The switch element 39 is affixed for rotation with a shaft 41 to which a knob 42 is affixed. The knob 42 is contained within a cylindrical recess 43 of the housing part 31 so as to be at least partially protected.

A seal 44 encircles the shaft 41 and is received in a recess in the housing portion 31 at the base of the recess 43 for effecting sealing. A further "O" ring seal 45 is disposed at the lower end of the shaft 41 where it joins the switch element 39 to further ensure good sealing.

The switch element 39 carries a contact 46 that is adapted to engage terminals 47 formed in a lower closure plate 48 of the switch 28. The closure plate 48 is held in position in a suitable manner and a "O" ring seal 49 further seals the assembly.

A detent mechanism is provided for retaining the switch 28 in one or all of its positions. The detent mechanism includes a detent ball 51 that is slideably supported in a bore of the switch element 39 and is urged by means of a spring 52, which is also contained within this bore toward a detent recess 53 formed in the housing part 35. As has been noted, the detent mechanism may serve to hold the switch 28 in each or any of its selected positions.

A coil compression spring 54 engages the housing 29 and the switch element 39 so as to normally urge the contacts 46 and terminal 47 toward an engagement when the switch is in the desired position. The switching elements are such that the associated electric motor that energizes the hydraulic system, can be switched either in an off, up or down condition. Rotation of the knob 42 will achieve this movement.

Figure 3:
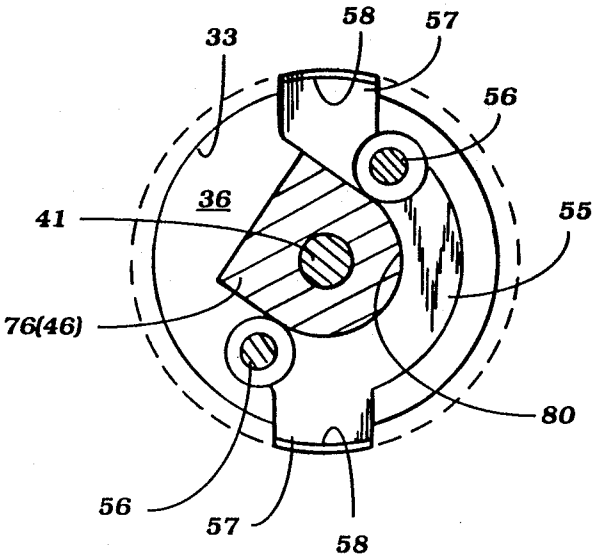
FIG. 3 is a cross-sectional view taken along the line 3—3 of FIG. 2 and shows the switch mechanism in a partially installed positioned.

In order to permit insertion and removal of the switch 28 into the housing 13, there is provided a retainer plate 55 that is affixed to the housing part 31 by means of a pair of screws 56. As may be best seen in FIGS. 3 and 4, the retainer plate 55 has a generally arculate configuration and is formed with a pair of ears or lugs 57. These lugs 57 are adapted to be received in complementary recesses 58 formed at diametrically opposite sides of the bore 33 in the gimbal housing 13 for insertion in an axial direction as shown in FIG. 3. Once the switch assembly 28 is fully inserted into the gimbal housing 13, it is rotated to the position shown in FIG. 4 so that the lugs 57 will move behind a shoulder that is formed at the base of the bore 33 so as to lock the switch in position. Thus, a lock of the bayonet type is provided that permits quick insertion and removal.

It should be readily apparent from the foregoing description that the described construction provides a conveniently located switch for operating the tilt and trim unit and which is rotary so that is will not be accidentally operated. In addition, the switch can be easily inserted and removed for servicing.

Although an embodiment of the invention is illustrated and described, various changes and modifications may be made without departing from the spirit and sculpt of the invention and defined by the appended claims.

I claim:

1. In a marine outboard drive adapted to be mounted on the transom of a watercraft hull containing a prime mover, said outboard drive comprising an outer housing and a supporting unit, a propulsion unit contained within said outer housing and adapted to be driven by the prime mover, said outer housing and said supporting unit being mounted on the transom for tilt and trim movement of said outer housing relative to said supporting unit, and power means interposed between said transom and said outboard drive for achieving power tilt and trim operation, the improvement comprising manually operated switch means carried by said outboard drive for operation initiation of said power means.

2. In a marine outboard drive as set forth in claim 1 wherein the manually operated switch means is positioned to be operated externally of the watercraft.

3. In a marine outboard motor as set forth in claim 2 wherein the manually operated switch means is mounted for operation by an operator reaching over the transom.

4. In a marine outboard drive as set forth claim 1 wherein the switch means comprises a rotary switch.

5. In a marine outboard drive as set forth in claim 4 wherein the rotary switch is mounted on the supporting unit and is detachably connected thereto.

6. In a marine outboard drive as set forth in claim 5 wherein the detachable connection comprises a bayonet type of lock.

7. In a marine outboard drive as set forth in claim 6 wherein the switch means comprises an outer housing having the bayonet type of lock and containing a rotary switching element controlled by a knob contained at least in part in a recess formed in the outer housing.

8. A switch for operating the power unit for adjusting the tilt and trim of a marine outboard drive comprising a generally cylindrical outer housing adapted to be detachably connected to an outer housing of the outboard drive unit, a rotary switch controlling knob contained within and supported by said generally cylindrical outer housing for access to an operator, contact means operated by said knob for controlling said power unit, and means for sealing said contact means within said outer housing.

9. A switch as set forth in claim 8 wherein the generally cylindrical outer housing has a cylindrical portion defining a cavity in which the knob is contained.

10. A switch as set forth in claim 9 wherein the generally cylindrical outer housing has a bayonet type lock to the upward drive outer housing.

* * * * *